US006401393B2

(12) United States Patent
Juntunen

(10) Patent No.: US 6,401,393 B2
(45) Date of Patent: Jun. 11, 2002

(54) DOOR CLOSING ARRANGEMENT FOR A DOUBLE DOOR

(75) Inventor: Harri Juntunen, Joensuu (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 09/788,130

(22) Filed: Feb. 16, 2001

(30) Foreign Application Priority Data

Feb. 18, 2000 (FI) ..... 20000373

(51) Int. Cl.[7] ..... E05C 7/04
(52) U.S. Cl. ..... 49/367
(58) Field of Search ..... 49/104, 109, 110, 49/112, 113, 114, 115, 366, 367, 368, 369, 506

(56) References Cited

U.S. PATENT DOCUMENTS

| | | | | | |
|---|---|---|---|---|---|
| 3,822,506 | A | * | 7/1974 | Fishbach | 49/367 |
| 3,895,461 | A | * | 7/1975 | Maynard et al. | 49/367 |
| 4,429,492 | A | * | 2/1984 | Imhoff | 49/367 |
| 4,583,324 | A | * | 4/1986 | Storz et al. | 49/367 |
| 4,949,505 | A | * | 8/1990 | Cohrs | 49/367 |
| 4,967,512 | A | * | 11/1990 | Schroder et al. | 49/367 |
| 5,944,399 | A | * | 8/1999 | Gillispie | 49/367 |

FOREIGN PATENT DOCUMENTS

| | | | | |
|---|---|---|---|---|
| DE | 3336739 | * | 4/1985 | 49/367 |
| DE | 3941455 | * | 6/1990 | 49/367 |

* cited by examiner

*Primary Examiner*—Jerry Redman
(74) *Attorney, Agent, or Firm*—John Smith-Hill; Smith-Hill and Bedell

(57) ABSTRACT

First and second door leaves are pivotable with respect to a door frame and each door leaf has a hinge edge at which it is hingedly attached to the door frame. Each door leaf is provided with a door closer and a pull arm for closing the door leaf. The door frame is provided with a guide rail mounted to the door frame for guiding movement of distal ends of the pull arms longitudinally of the guide member. During closing movement of the second door leaf, the distal end of the second pull arm moves along the guide rail initially in an allowing direction, away from the hinge edge of the second door leaf, and subsequently in a blocking direction, towards the hinge edge of the second door leaf. During closing movement of the second door leaf, a blocking device allows movement of the distal end of the second pull arm past the blocking device in the allowing direction and selectively prevents return movement of the distal end of the second pull arm past the blocking device in the blocking direction.

17 Claims, 4 Drawing Sheets

DOOR CLOSING ARRANGEMENT FOR A DOUBLE DOOR

BACKGROUND OF THE INVENTION

The invention relates to a closure sequence control arrangement for a turnable double door and to a method for controlling closure sequence in a turnable double door.

In order to lock the leaves of a double door to each other, one of the door leaves is preferably provided with a latch bolt. As a consequence of this the door leaves must be closed in a certain order so that the door leaf provided with the latch bolt is closed last. The spring-loaded latch bolt has a bevelled guide surface, which forces the latch bolt into the lock casing within the door leaf in order to allow the door leaf in question to turn to its fully closed position. In this position the latch bolt, urged by its spring, is again able to move to its protruding position, in which it locks the door leaves to each other. One closure sequence control arrangement for door leaves suitable for the purpose is disclosed in the publication EP 0 458 034. This known solution is, however, complicated as to its construction and the installation thereof is rather cumbersome.

U.S. Pat. Application Ser. No. 09/047,133, now abandoned, corresponding to the publication FI 102100, discloses a closure sequence control arrangement for a turnable double door, in which the leaves of the double door are provided with door closers and swing arms and with a guide rail or the like for guiding the distal ends of the swing arms relative to the door closers, and with a sequence control means arranged in connection with the guide rail and including a connection piece arranged in the guide rail between the distal ends of the swing arms and movable against the force of a spring, a support element stationarily supported to the guide rail, and a movable stop member. The sequence control means are arranged in cooperation with the distal ends of the swing arms so that at the end phase of the closing movement of the door leaves the stop member prevents movement of the distal end of the swing arm of the second door leaf in the guide rail until the distal end of the swing arm of the first door leaf has, through the connection piece, acted on the stop member and the blocking member then allows closing of the second door leaf. Here pressure is exerted by means of the distal end of the swing arm through the connection piece against the force of the spring of the closure sequence control means, whereby the stop member can move so as to allow opening of the second door leaf.

An aim of the invention is to provide a novel arrangement for the turnable leaves of a double door, which secures the desired closure order for the door leaves, but which has a simple construction, is reliable as to its operation and which is easy to install and to adapt to double doors of different width. An aim of the invention is also to provide an arrangement, by means of which a successful sequence control for door leaves is secured under all conditions.

Within the scope of this application the term "allowing direction" means the direction away from the hinge side of frame of the door leaf and the term "blocking direction" means the direction towards the hinge side of frame of the door leaf.

SUMMARY OF THE INVENTION

In a closure sequence control arrangement for a turnable double door according to one embodiment of the invention, the double door is provided with a first door closer and a first pull arm for closing a first door leaf and with a second door closer and a second pull arm for closing a second door leaf, with a guide rail or the like for guiding the distal ends of the pull arms relative to the door closers, and with a closure sequence control means arranged in connection with the guide rail. The closure sequence control means is arranged to cooperate with the distal ends of the pull arms and includes an arrangement for allowing the distal end of the second pull arm to move past the closure sequence control means in the allowing direction at the end phase of the closing movement of the door leaves.

In a closure sequence control arrangement for a turnable double door according to another embodiment of the invention the double door is provided with a first door closer and a first pull arm for closing a first door leaf and with a second door closer and a second pull arm for closing a second door leaf, with a guide rail or the like for guiding the distal ends of the pull arms relative to the door closers, with a closure sequence control means arranged to cooperate with the distal ends of the pull arms at the end phase of the closing movement of the door leaves, and with a connection piece for transferring the effect of the distal end of the first pull arm to the closure sequence control means. The distal end of the first pull arm and the connection piece include members for transmitting pulling force therebetween. By this arrangement the operation of the closure sequence control can be provided such that the first door leaf is closed before the second door leaf.

In accordance with the invention the closure sequence control means is arranged to prevent movement of the distal end of the second pull arm in the guide rail until the distal end of the first pull arm has acted on the closure sequence control means through the connection piece so that it allows closing of the second door leaf. The closure sequence control means includes with advantage a connection piece arranged in the guide rail between the distal ends of the pull arms to be pulled against the force of a spring, a support element, which is stationarily supported to the guide rail, and a movable stop member. The closure sequence control means cooperates with the distal ends of the pull arms in the end phase of the closing movement of the door leaves so that the stop member prevents movement of the distal end of the second pull arm in the guide rail until the distal end of the first pull arm has by means of a pulling movement acted on the closure sequence control means through the connection piece so that the stop member allows closing of the second door leaf.

The connection piece comprises an arm member and a guide element arranged at one end thereof, and the arm part and/or the guide element includes a counter engagement piece for an engagement piece associated with the first pull arm for providing a selective mechanical coupling between the connection piece and the first pull arm. The engagement piece comprises with advantage a hook or the like and the counter engagement piece comprises a pin or the like, whereby these can mutually provide a mechanical coupling transmitting at least pulling force. The hook or the like can be stationarily connected to the first pull arm as an extension thereof. The door closers can with advantage be fitted to the door leaves on the opposite sides relative to the door hinges or to the opposite sides relative to the opening side of the doors. Thus a suitable geometry can obtained for door closure sequence control according to the invention.

According to an advantageous embodiment of a method for controlling closure sequence in a turnable double door provided with a first door closer and a first pull arm for closing a first door leaf and with a second door closer and a second pull arm for closing a second door leaf, with a guide rail or the like for guiding the distal ends of the pull arms relative to the door closers, and with a closure sequence control means arranged to cooperate with the distal ends of the pull arms in the end phase of the closing movement of the door leaves, the closure sequence control means prevents movement of the distal end of the second pull arm in the guide rail or the like until the distal end of the first pull arm has acted on the closure sequence control means through the connection piece so that it allows closing of the second door leaf. The distal end of the first pull arm acts on the closure sequence control means by generating a pulling force, and the connection piece transmits the pulling force to the closure sequence control means.

According to an advantageous embodiment of the invention the closure sequence control means include a support element, which is stationarily supported to the guide rail, and a movable stop member and a guide element to be fitted to the end of the connection piece on the side of the support element. The support element is provided with an elongated guide opening or passage which receives the stop member and is longer in the direction of movement of the distal end of the second pull arm than perpendicular to the direction of movement. The stop member is arranged in the guide opening so that in its stopping position the stop member extends partly out from the guide opening, into the path of movement of the distal end of the second pull arm. The support element includes with advantage a guide surface parallel to the direction of the guide rail and at which the elongated guide opening debouches. The guide element is provided with a blocking member, which cooperates with the guide rail and the guide surface of the support element so that when the door leaves are open the blocking member is under the influence of the spring arranged at such a position with regard to the guide opening that it allows movement of the stop member into its releasing position when the distal end of the second pull arm moves in the allowing direction, and so that at the same time it prevents movement of the stop member into its releasing position when the distal end of the second pull arm is moving in the blocking direction.

Several advantages can be obtained by means of the invention. Among others, closure sequence control for a double door can be carried out in a very late phase of closure, whereby the sequence control occurs also in a secure or reliable way. In addition by means of the arrangement according to invention the adjustment of speed by the door closers is no longer so important for the sequence control to succeed.

BRIEF DESCRIPTION OF THE DRAWINGS

In the follow the invention is described by way of example with reference to the attached drawings, in which.

DETAILED DESCRIPTION

Figure 1:
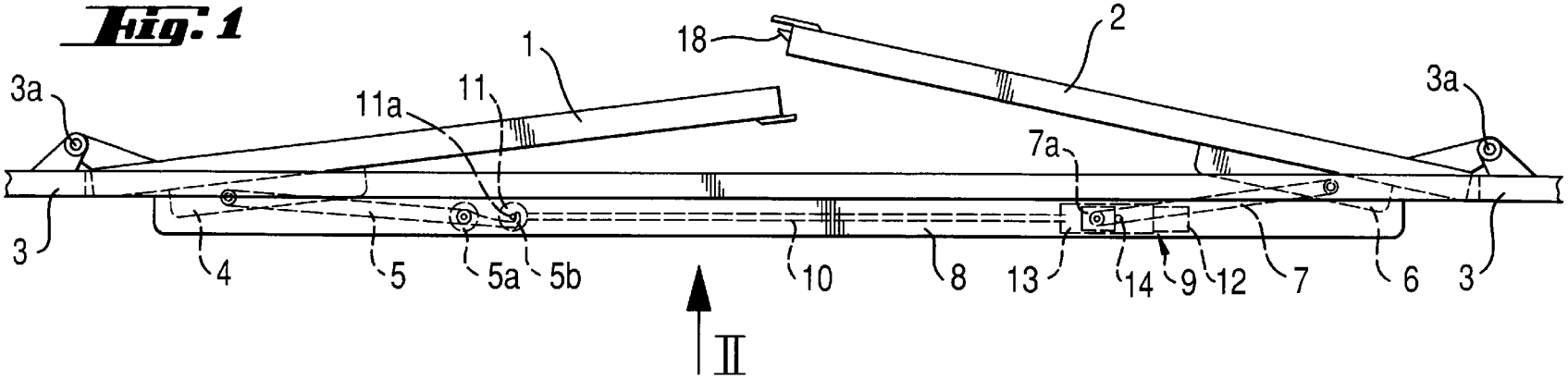
FIG. 1 shows schematically a door closer arrangement for a double door viewed from above with the turnable door leaves opened in a position, in which a closure sequence control means is estimated to determine the closing order of the door leaves.
Figure 2:
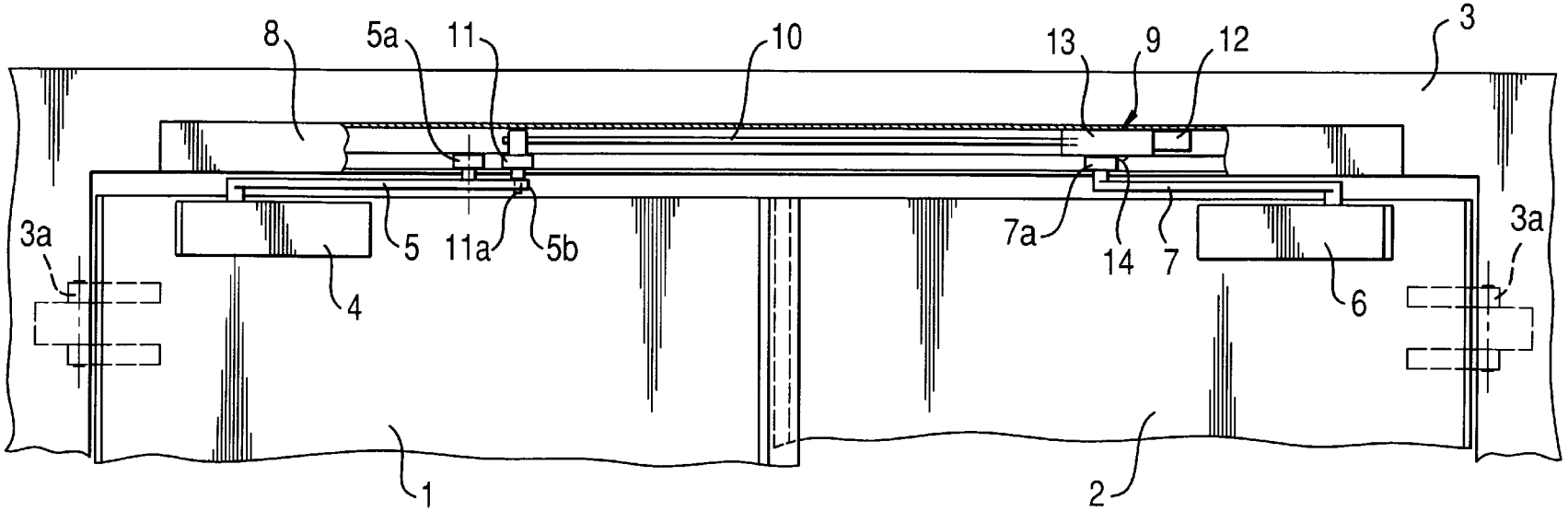
FIG. 2 shows the arrangement of FIG. 1 as a side view in the direction of the arrow II and partly in section.

In the drawings 1 and 2 indicate two turnable door leaves for a double door. The door leaves 1 and 2 are turnably journalled to a door frame 3 by means of hinges 3*a*. The door leaf 1 is provided with a door closer 4, which has a pull arm 5, and the door leaf 2 is provided with a door closer 6, which has a pull arm 7. The door closers are fitted to the door leaves on the opposite side relative to the hinges 3*a*, or on the opposite side relative to the opening side of the door leaves, whereby a favorable geometry is accomplished, in which during closing movement of the door leaves the ends 5*a*, 7*a* of the pull arms 5, 7 initially move away from the respective hinges (allowing direction) and during the final phase of the closing movement the ends 5*a*, 7*a* move towards the respective hinges (blocking direction). Advantageously the geometry is arranged so that the direction of movement of the distal end changes when the door leaf is at an angle of about 15°. The closing angle at which the direction of movement changes can be selected within a range from about 15° to almost 0° by means of suitable mounting of the arrangement. This change in direction occurs during closing movement of the door when the fulcrum point at which the arm 5, for example, which is connected to the closer 6, crosses the line drawn through the fulcrum point of the hinge 3*a* and the end 5*a* of the arm, i.e. when the distance from the fulcrum of the hinge to the distal end of the pull arm is a maximum. By this arrangement it is possible for the closing angle of the first door leaf at which the closure sequence control means releases the second door leaf 2 to be reduced relative to other closure sequence control mechanisms. Hereby, the door leaves are closed in the correct order independent of the speed control of the door closers.

A guide rail 8 or the like is supported to the upper part of the door frame 3 (not shown in more detail) above the door leaves. The guide rail 8 guides the ends 5*a* and 7*a* of the pull arms 5 and 7 during the turning movements of the door leaves. In addition the guide rail 8 is provided with a closure sequence control means 9, which ensures that the door leaf 2, which is provided with a latch bolt 18, is closed only after the door leaf 1 has closed. If the door leaf 2 were able to close before the door leaf 1, the door leaf 1 would not be able to turn past the door leaf 2 and the latch bolt 18 would not be able to move to its closed position, in which the latch bolt 18 locks the door leaves to each other.

The closure sequence control means 9 includes a connection piece movable in the guide rail 8 and comprising an arm member or rod 10, provided at one end with a counter piece 11 and at its other end with a guide element 12. The counter piece 11 cooperates with the distal end 5*a* of the first pull arm 5 so that transmission of pulling force from the pull arm 5 to the connection piece 10 is possible. The guide element 12 cooperates with a support element 13 which is fixed to the guide rail 8, e.g. by screws (not shown). The guide element 12 has a guide surface 12*a*, which together with the guide surface 13*a* in the support element 13 and the inner surface of the guide rail 8 guides movement of the element 12 and hence of the arm member 10. The arm member 10 or an extension thereof extends through a part of the support element 13 and is fixed to the guide element 12. A return spring 15 is arranged in connection with the arm member 10 or its extension between the support element 13 and the guide element 12. When the two door leaves are open, the spring 15 urges the guide element 12 to the position of FIG. 3.

An elongated guide opening 13*b* opens at the guide surface 13*a*. A stop member 14 is located in the guide opening. The guide opening 13*b* is so formed that the stop member 14 can partly project from the opening 13*b* to the position shown in FIG. 3, in which it prevents movement of the end 7*a* of the pull arm 7 along the guide rail 8 in the blocking direction (to the right of FIG. 3) and thereby prevents turning of the door leaf 2 further to its fully closed position. The guide opening 13*b* is elongated in the direction of movement of the guide element 12, whereby the stop member 14 can move in the guide opening in the direction of the guide surface 13*a*, i.e. the stop member is able to move lengthwise of the guide rail 8. Thus the arrangement 13*b*, 12*a* allows the end 7*a* of the second pull arm to pass the closure sequence control means in the allowing direction (to the left of FIG. 3), independent of the position of the guide element 12.

Figure 3:
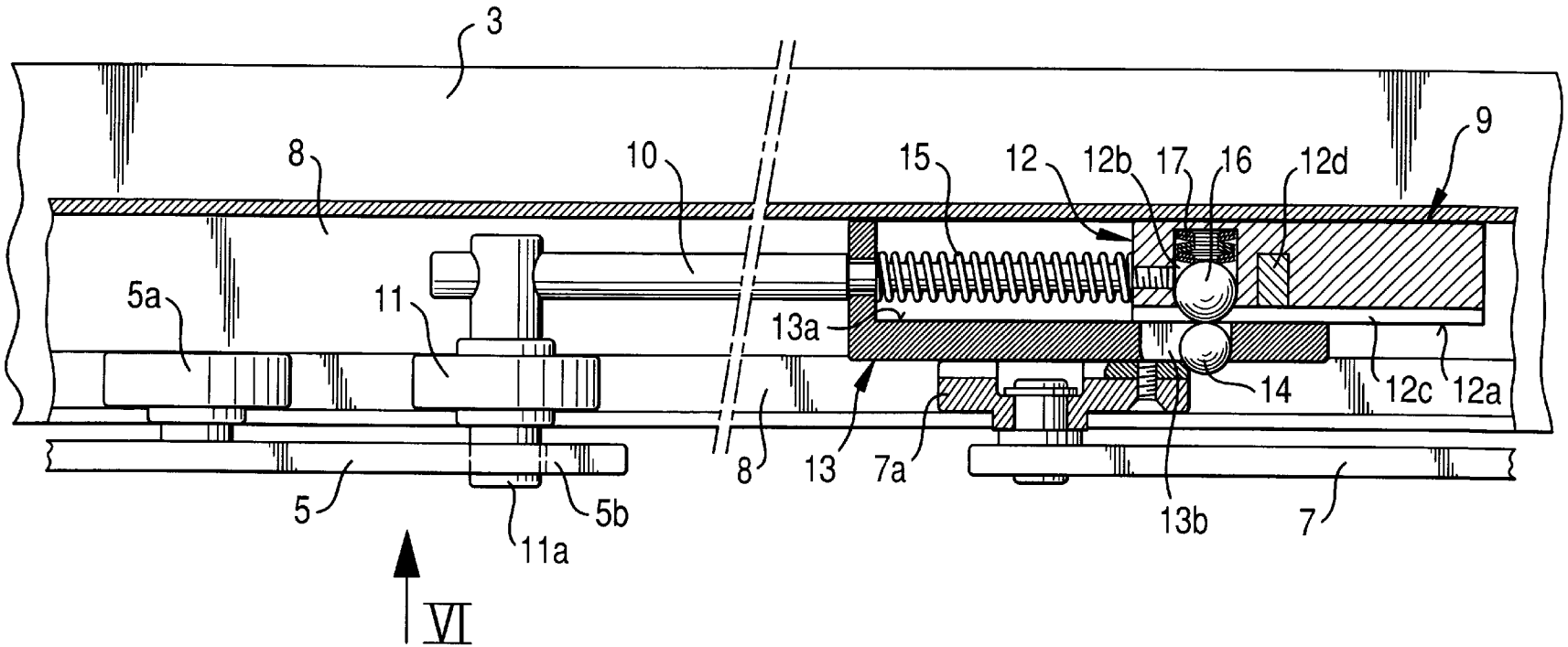
FIG. 3 shows a partial enlarged view of the closure sequence control means of FIG. 2.
Figure 5:
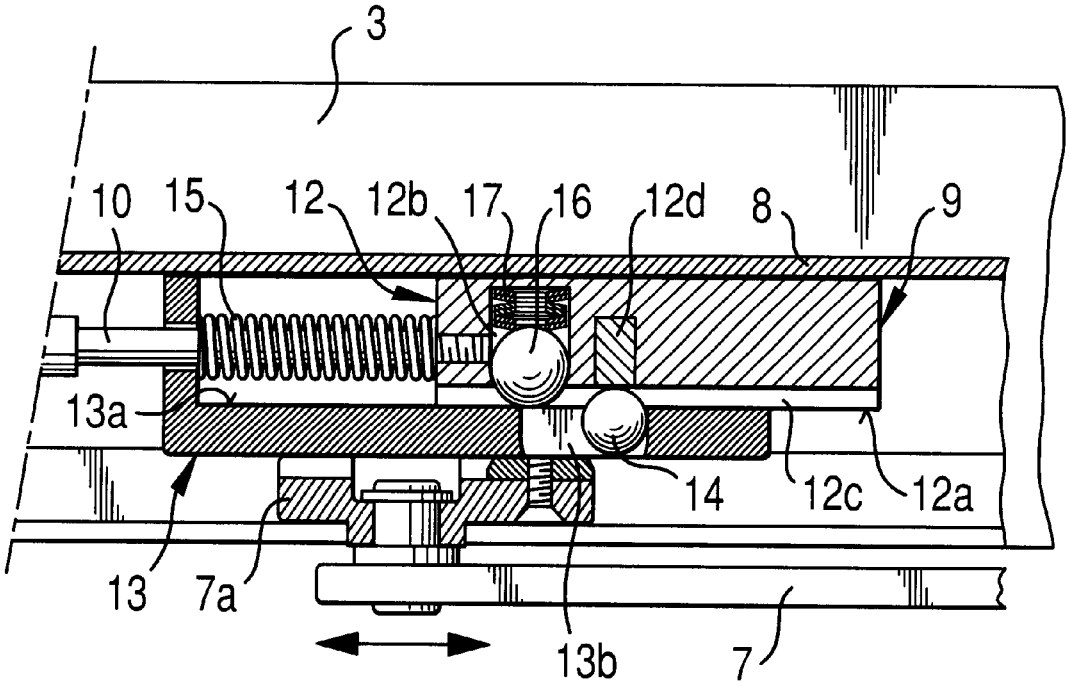
FIG. 5 shows a partial enlarged view of the closure sequence control means of FIG. 2 in a situation in which the closure sequence control means is in a position allowing closure of the second door leaf.

The guide element 12 includes a bore 12*b*, in which there is a blocking member 16 serving as a blocking means, which together with a spring 17 prevents the stop member 14 from moving from the position of FIG. 3 into the position shown in FIG. 5 and thereby releasing the end 7*a* of the pull arm 7.

The blocking member 16 cooperates with the guide rail 8 and the guide surface 13*a* of the support element so that when the door leaves are open the spring 15 positions the guide element 12 so that the blocking member 16 is arranged at such a position lengthwise of the guide opening 13*b* that it allows movement of the stop member 14 into its releasing position when the end 7*a* moves in the allowing direction and prevents movement of the stop member 14 into its releasing position when the end 7*a* moves in the blocking direction. See FIGS. 3 and 4.

In the position shown in FIG. 3, the blocking member 16 is at the position of the stop member 14. The guide element 12 includes an extension part or groove 12*c* extending parallel with the longitudinal extent of the guide surface 13*a* and located at a distance from the guide surface 13*a*. After movement of the guide element 12 and thus of the blocking member 16 away from the stop member 14, to the position shown in FIG. 5, the extension part 12*c* allows movement of the stop member 14 from the guide opening 13*b* to a position releasing the end 7*a*. The extension part 12*c* prevents, however, movement of the stop member 14 entirely out from the guide opening 13*b*. The extension part 12*c* extends both to the left and to the right of the blocking member 16, as seen in FIG. 3.

In addition the guide element 12 includes a magnet 12*d*. When the guide element 12 is moved to the left of FIG. 3, to the position shown in FIG. 5, the magnet retains the stop member 14 in a position in which it permits movement of the end 7*a* of the pull arm 7. The magnet 12*d* is mounted in the extension part 12c, in the vicinity of the blocking member 16, and it retains the stop member 14 in its position in a controlled way and does not affect in any way the movement of the end 7*a* of the pull arm.

The door closer 4 is fitted to the door leaf 2 on the opposite side relative to the hinge 3*a*, or on the opposite side relative to the opening side of the door, whereby an advantageous geometry is accomplished, in which the end 7*a* of the pull arm 7 first moves away from the hinge when the door is closed and later the end 7*a* moves towards the hinge at the last phase of the closing of the door.

Figure 4:
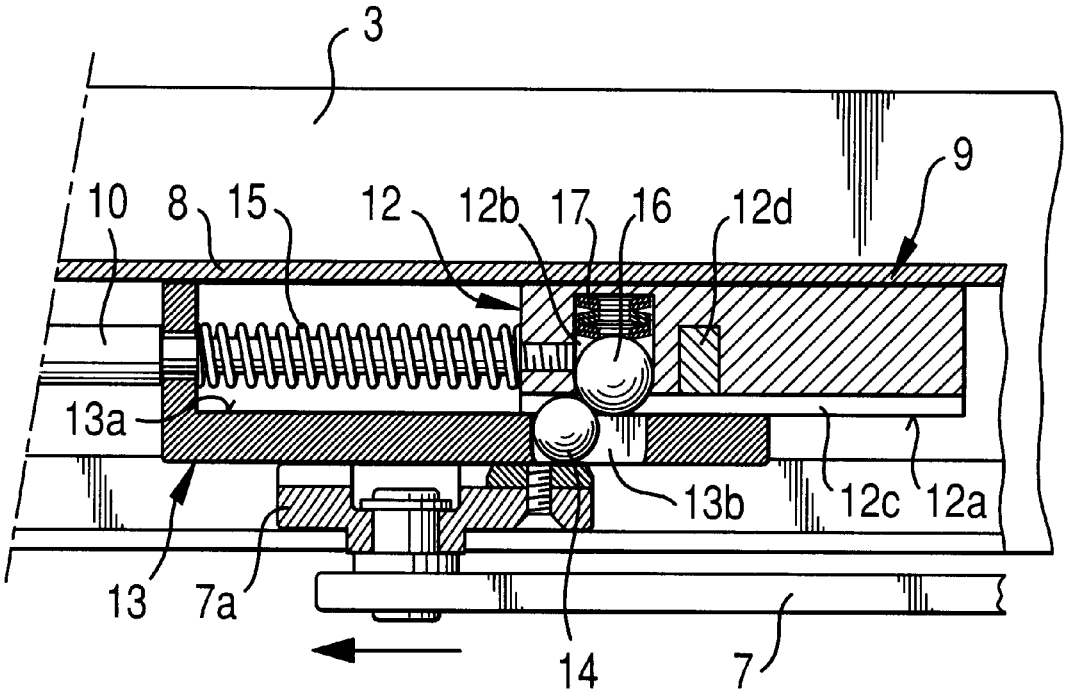
FIG. 4 shows a partial enlarged view of the closure sequence control means of FIG. 2 in the direction of the arrow IV in a situation in which the closure sequence control means is moving into a position for preventing closure of the second door leaf.

The operation of the closure sequence control means is as follows. If both the door leaves 1 and 2 are fully open and one tries to close the door leaf 2 including the latch bolt 18 first, the door leaf 2 turns until the end 7*a* of its pull arm 7 moves as shown in FIG. 4 past the stop member 14 in the allowing direction away from the hinge. The end 7*a* pushes the stop member in the elongated guide opening in the support element into the space 12*c* reserved for it (FIG. 4), in other words into the extension part, and the stop member moves to the left of the blocking member 16. As shown in FIG. 4, the stop member 14 projects above the surface 13*a*, into the extension part 12*c*. As the end 7*a* continues beyond the position shown in FIG. 4, the stop member 14 falls so that it protrudes downwards from the guide opening 13*b* and no longer projects above the surface 13*a*. When the movement has continued so far that the direction of movement of the end 7*a* is changed, and the end 7*a* moves towards the hinge due to the geometry used, the end 7*a* engages the stop member 14 partly protruding from the guide opening 13*b* and forces the stop member to the right of FIG. 4, to the position of the blocking member 16, as shown in FIG. 3. In this case, the blocking member 16 prevents movement of the stop member 14 into its releasing position, so the door leaf 2 remains at this turning angle. This corresponds at its largest to a turning angle of about 15°, typically 8°–13°, from the fully closed position. The elongated guide opening 13*b* is with advantage sufficiently long that the stop member 14 can move from the position of the blocking member into the extension part 12*c*.

In the sequence control the end 7*a* of the second pull arm thus goes past the stop member 14 in the allowing direction of the movement, after which the direction of movement of the end 7*a* changes to the blocking direction and the stop member 14 prevents movement of the end 7*a* in the blocking direction until the end 5*a* of the first pull arm has a releasing effect on the stop member 14 by providing pulling force to the closure sequence control means.

Figure 6:
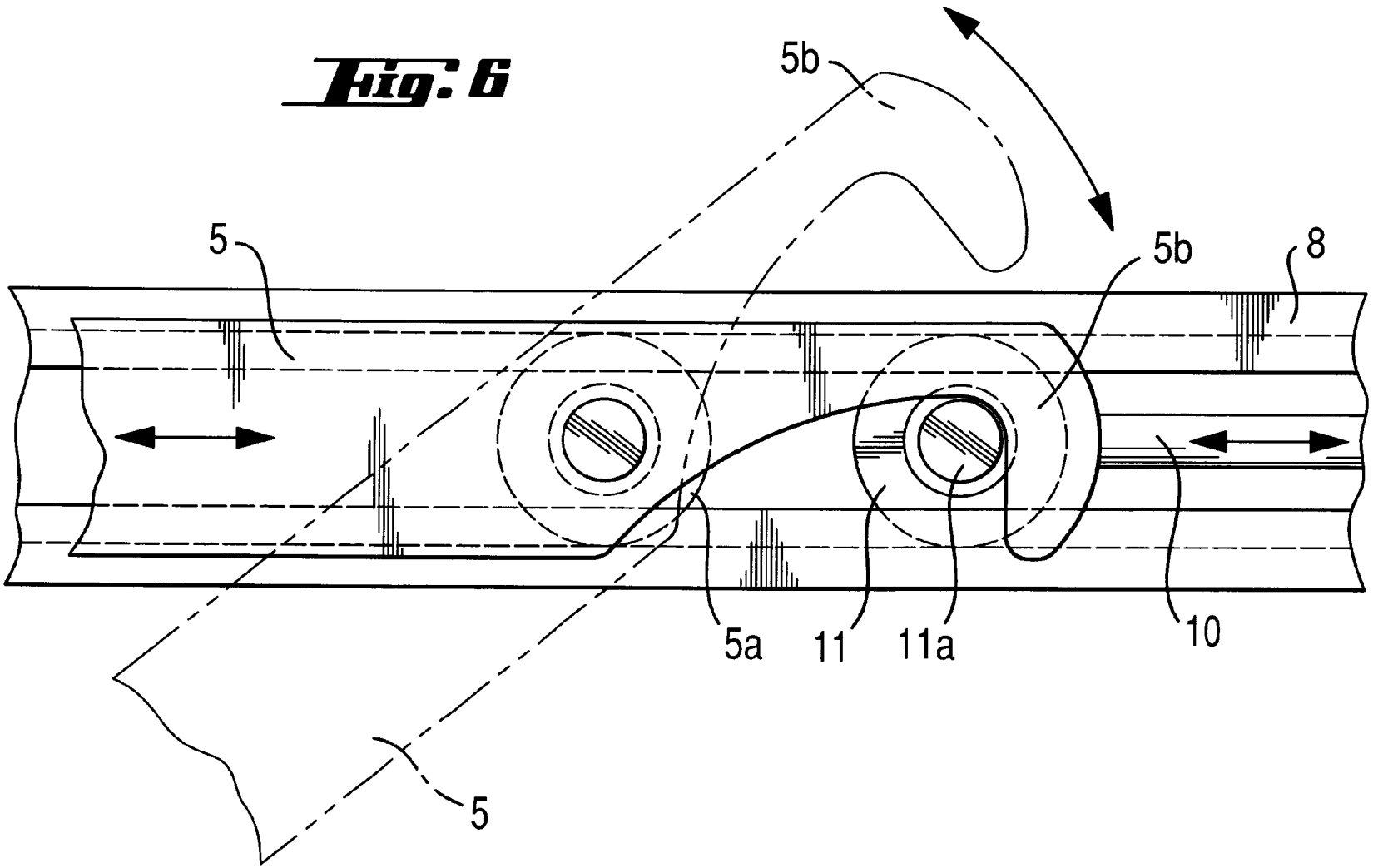
FIG. 6 shows a partial enlarged view of a releasing arrangement for the closure sequence control means of FIG. 1.

In order to close the door leaf 2, the door leaf 1 must first be turned so that the end 5*a* of its pull arm 5 engages the counter piece 11 at the end of the arm member 10. The releasing arrangement for the closure sequence control means is so accomplished that the connection piece 10, 11, 12 comprises the arm member 10 and the guide element 11 arranged at one end thereof and the arm member and/or the guide element comprises a counter engagement piece 11*a* for an engagement piece 5*b* that is connected to the pull arm 5 in order to provide a selective mechanical coupling between the connection piece 10, 11, 12 and the pull arm 5. As shown in FIGS. 3 and 6, the engagement piece 5*b* is a hook and the counter engagement piece 11*a* is a pin. When the door leaf 1 is closed further the hook 5*b* extending from the end 5*a* turns in a way shown in FIG. 6 around the pin 11*a* connected to the guide element 11 and provides an engagement between these for transmitting pulling force.

The engagement piece or hook 5*b* pulls the connection piece 10, 11, 12 against the force of the spring 15 to the position shown in FIG. 5. Here the blocking member 16 is spaced from the stop member 14, whereby the stop member 14 can move partly out from the guide opening 13*b* into the extension part 12*c* and thus release the end 7*a* of the pull arm 7. In this condition the door closer 6 can turn the door leaf 2 to its fully closed position, in which the latch bolt 18 locks the door leaves 1 and 2 to each other.

As apparent from the figures the stop member 14 can with advantage be a ball. The stop member may naturally have another form, for example it may be elongated, and when needed it may include a recess for receiving the end 7*a* of the pull arm. Correspondingly the end 7*a* of the pull arm 7 and the support element 13, at least for the part including the guide opening 13*b*, should be manufactured of a hard and wear resistant material, for instance hardened steel.

The arrangement shown in the figures includes a one piece guide rail 8 of uniform configuration along its length. In principle the guide rail could alternatively be in two parts so that the opposite ends of the arm member 10 are located in separate segments of the guide rail.

The arm member 10 may be detachably fixed at its ends to the counter piece 11 and/or to the guide element 12, for instance by threads, in which case the functional length of the arm member 10 can be adjusted in accordance with the width of the door opening and the door leaves in each case. In addition when needed the arm member 10 may also be truncated, i.e. cut to a shorter length, when the arrangement according to the invention is applied to a substantially narrower double door. When desired the support element 13 also can be detachably fixed to the guide rail 8, for instance by screws, whereby by changing the position of the screws one can change the opening angle of the door leaves at which the closure sequence control means is activated.

It is clear that the above described hook-pin combination in connection with the end 5*a* of the pull arm and the guide element 11 may in practice be implemented in many ways, for instance inside of the guide rail. In addition instead of a hook another mechanism providing selective mechanical coupling can be used.

Also the support element can be arranged relative to the guide element such that the pulling force of the pull arm is transmitted to the spring as an extending force and not as a compressing force as shown in the attached figures.

Thus the invention is not limited to the embodiment shown but several modifications are feasible within the scope of the attached claims.

What is claimed is:

1. A closure sequence controller for a pair of first and second door leaves pivotable with respect to a door frame, each door leaf having a hinge edge at which the door is hingedly attached to the door frame, the first door leaf being provided with a first door closer and a first pull arm for closing the first door leaf, the second door leaf being provided with a second door closer and a second pull arm for closing the second door leaf, and the door frame being provided with an elongate guide member for mounting to the door frame for guiding movement of distal ends of the pull arms respectively longitudinally of the guide member, and wherein during closing movement of the second door leaf, the distal end of the second pull arm moves along the guide member initially in an allowing direction, away from the hinge edge of the second door leaf, and subsequently in a blocking direction, towards the hinge edge of the second door leaf, and the closure sequence controller comprises a blocking device which, during closing movement of the second door leaf, allows movement of the distal end of the second pull arm past the blocking device in the allowing direction and selectively prevents return movement of the distal 7*a* end of the second pull arm past the blocking 1*b* device in the blocking direction.

2. A closure sequence controller according to claim 1, wherein the blocking device includes a support element which is attached to the guide rail in a manner preventing relative movement thereof, and a stop member held by the support element, and the blocking device has a first condition in which the stop member projects into the path of movement of the distal end of the second pull arm and blocks movement of the distal end of the second pull arm in the blocking direction and a second condition in which the stop member allows movement of the distal end of the second pull arm.

3. A closure sequence controller according to claim 2, wherein the support element is formed with an elongated guide opening, the stop member is located in the elongated opening, the stop member has a protruding position in which it protrudes into the path of movement of the distal end of the second pull arm and a releasing position in which it does not protrude into the path of movement of the distal end of the second pull arm, in the event that the stop member is in its protruding position and the distal end of the second pull arm moves in the blocking direction towards the stop member, the distal end of the second pull arm exerts a force on the stop member urging the stop member from its protruding position to its releasing position, the blocking device includes a guide element which is movable longitudinally of the guide rail, and in the first condition of the blocking device the guide element prevents movement of the stop member from its protruding position to its releasing position and in the second condition of the blocking device the guide element allows movement of the stop member from its protruding position to its releasing position.

4. A closure sequence controller according to claim 3, comprising a connection means for selectively connecting the guide element to the distal end of the first pull arm, whereby the guide element is selectively movable relative to the support element in response to force exerted by the first pull arm from a first position, corresponding to the first condition of the blocking device, to a second position, corresponding to the second condition of the blocking device.

5. A closure sequence controller according to claim 4, further comprising a return spring urging the guide element from its second position to its first position.

6. A closure sequence controller according to claim 3, wherein the support element includes a blocking member and when the door leaves are open a return spring urges the guide element to a position such that the blocking member allows movement of the stop member to its releasing position when the distal end of the second pull arm moves in the allowing direction and prevents movement of the stop member to its releasing position when the distal end of the second pull arm moves in the blocking direction.

7. A closure sequence controller according to claim 6, wherein the support element has a guide surface extending parallel to the guide rail and at which the guide passage opens, and the guide element is formed with an extension groove extending parallel to the guide rail and open towards the guide surface of the support element, the extension groove allowing movement of the stop member to its releasing position but not allowing movement of the stop member out of the guide passage, the extension groove extending beyond the blocking member both towards and away from the hinge edge of the second door leaf.

8. A closure sequence controller according to claim 2, wherein the stop member is made of magnetic material and the guide element includes a magnet for attracting the stop member towards its releasing position.

9. A closure sequence controller according to claim 6, wherein the blocking member is a ball that is spring loaded towards the stop member.

10. A closure sequence controller according to claim 4, wherein the connection means comprises an arm member having first and second ends, the arm member being attached at its first end to a counter piece cooperating with the distal end of the first pull arm and at its second end to the guide element.

11. A closure sequence controller according to claim 1, further including a connection means for selectively connecting the guide element to the distal end of the first pull arm, and wherein the blocking device is responsive to a pulling force transmitted by the connection means to release the distal end of the second pull arm.

12. A closure sequence controller according to claim 1, wherein the distal end of the first pull arm is provided with an engagement member and the controller includes a connection piece provided at a first end with a counter engagement member for selective engagement with the engagement member, whereby selective mechanical coupling is provided between the first pull arm and the connection piece, the connection piece being connected at a second end to the guide element.

13. A closure sequence controller according to claim 12, wherein the engagement member is a hook and the counter engagement member is a pin.

14. A door installation including:

a door frame, a pair of first and second door leaves, each door leaf having a hinge edge at which the door is hingedly attached to the door frame, a first door closer and a first pull arm for closing the first door leaf, a second door closer and a second pull arm for closing the second door leaf, an elongate guide member mounted to the door frame for guiding movement of distal ends of the pull arms respectively longitudinally of the guide member, and wherein during closing movement of the second door leaf, the distal end of the second pull arm moves along the guide member initially in an allowing direction, away from the hinge edge of the second door leaf, and subsequently in a blocking direction, towards the hinge edge of the second door leaf, and a closure sequence controller comprising a blocking device which, during closing movement of the second door leaf, allows movement of the distal end of the second pull arm past the blocking device in the allowing direction and selectively prevents return movement of the distal end of the second pull arm past the blocking device in the blocking direction.

15. A door installation according to claim 14, wherein each door leaf has first and second opposite sides, the door leaves are hingedly attached to the door frame by hinges at the first side of each door leaf, and the door closers are mounted to the door leaves at the second side of each door leaf.

16. A method of controlling closure sequence of a pair of first and second door leaves pivotable with respect to a door frame, each door leaf having a hinge edge at which the door is hingedly attached to the door frame, the first door leaf being provided with a first door closer and a first pull arm for closing the first door leaf, the second door leaf being provided with a second door closer and a second pull arm for closing the second door leaf, and the door frame being provided with an elongate guide member mounted to the door frame for guiding movement of distal ends of the pull arms respectively longitudinally of the guide member, and wherein during closing movement of the second door leaf, the distal end of the second pull arm moves along the guide member initially in an allowing direction, away from the hinge edge of the second door leaf, and subsequently in a blocking direction, towards the hinge edge of the second door leaf, and the method comprises, during closing movement of the door leaves:

allowing movement of the distal end of the second pull arm past a waiting position in the allowing direction, if the first door leaf has reached a closing angle such that the first door leaf will close before the second door leaf, allowing return movement of the distal end of the second pull arm past the waiting position in the blocking direction, and otherwise preventing return movement of the distal end of the second pull arm past the waiting position in the blocking direction until the first door leaf has reached a closing angle such that the first door leaf will close before the second door leaf and then allowing movement of the distal end of the second pull arm past the waiting position in the blocking direction.

17. A method according to claim 16, comprising allowing movement of the distal end of the second pull arm past the waiting position in the blocking direction in response to a pulling force transmitted from the distal end of the first pull arm.

* * * * *

UNITED STATES PATENT AND TRADEMARK OFFICE

CERTIFICATE OF CORRECTION

PATENT NO. : 6,401,393 B2
DATED : June 11, 2002
INVENTOR(S) : Harri Juntunen

It is certified that error appears in the above-identified patent and that said Letters Patent is hereby corrected as shown below:

Column 7,
Line 58, "7*a*" should be deleted after "distal" and "1*b*" should be deleted after "blocking".

Signed and Sealed this

Eighth Day of October, 2002

*Attest:*

*Attesting Officer*

JAMES E. ROGAN
*Director of the United States Patent and Trademark Office*